United States Patent [19]

Madonna

[11] 3,965,624

[45] June 29, 1976

[54] ROOM CEILING CONSTRUCTION WITH RECESSED DOME MOUNTED THEREIN AND THE METHOD OF MOUNTING THE SAME

[75] Inventor: Thomas P. Madonna, Navarre, Minn.

[73] Assignee: Madonna Corporation, Minneapolis, Minn.

[22] Filed: Feb. 10, 1975

[21] Appl. No.: 548,392

Related U.S. Application Data

[63] Continuation of Ser. No. 400,379, Sept. 24, 1973, abandoned.

[52] U.S. Cl. ..... 52/28; 52/741; 240/78 H

[51] Int. Cl.[2] ..... E04F 19/00

[58] Field of Search ..... 52/27, 28, 741, 39; 240/78 G, 78 H, 78 LG

[56] References Cited

UNITED STATES PATENTS

| | | | |
|---|---|---|---|
| 2,978,572 | 4/1961 | Bodian | 240/78 H |
| 3,556,320 | 1/1971 | Henderson | 52/27 X |
| 3,753,217 | 8/1973 | Willfurth | 52/28 X |

*Primary Examiner*—Ernest R. Purser
*Assistant Examiner*—Carl D. Friedman
*Attorney, Agent, or Firm*—John W. Adams

[57] ABSTRACT

This is a recess ceiling dome particularly adapted to be installed in an existing building and specifically includes supporting members for ceiling joists that have been cut out to provide the opening to receive the dome which is adapted to permit a chandelier to be mounted therein while still providing adequate head room thereunder. This invention also consists in the method of installing the dome which includes initially cutting out an opening in the finished layer of the ceiling to expose the ceiling joists to be cut, supporting each of the joists to be cut from a portion of the frame structure of the existing building thereafter cutting through the joists around the edges of the opening and installing a chandelier receiving dome in the opening thus provided.

12 Claims, 5 Drawing Figures

ROOM CEILING CONSTRUCTION WITH RECESSED DOME MOUNTED THEREIN AND THE METHOD OF MOUNTING THE SAME

This application is a continuation of application Ser. No. 400,379, filed September 24, 1973, now abandoned.

In the past ceiling domes in excess of four or five feet in diameter have been relatively difficult and expensive to install even during initial construction of a home. This involves cutting out the ceiling including the supporting joists and requires additional support for all of the cut joist members as well as for the dome and chandelier mounted therein.

It is an object of this invention to provide a room ceiling structure of the type having spaced structural joists and in which a recess dome is mounted which is substantially larger than the spacing between the joists which extends a substantial distance above the height of the joists and which is adapted to receive and support a suspended light fixture therefrom and receive a substantial portion of the suspended light fixture within the recess of the dome.

It is also an object of the present invention to provide a method for installing a recess dome in a previously constructed finished ceiling which is particularly adapted for a "do-it-yourself" type project.

More specifically it is an object to provide a method which includes supporting the joists to be cut out from the preexisting frame structure of the building and thereafter cutting the joists around the edges of the desired opening and installing the dome and a chandelier in the opening.

It is another object of the invention to provide a supporting structure for the joists which have been cut out to produce a dome-receiving opening with a dome mounted therein with a chandelier suspended therefrom and means for supporting the dome and chandelier in said opening.

These and other objects and advantages of this invention will more fully appear from the following description made in connection with the accompanying drawings in which like reference characters refer to similar parts throughout the several views, and, in which.

Figure 1:
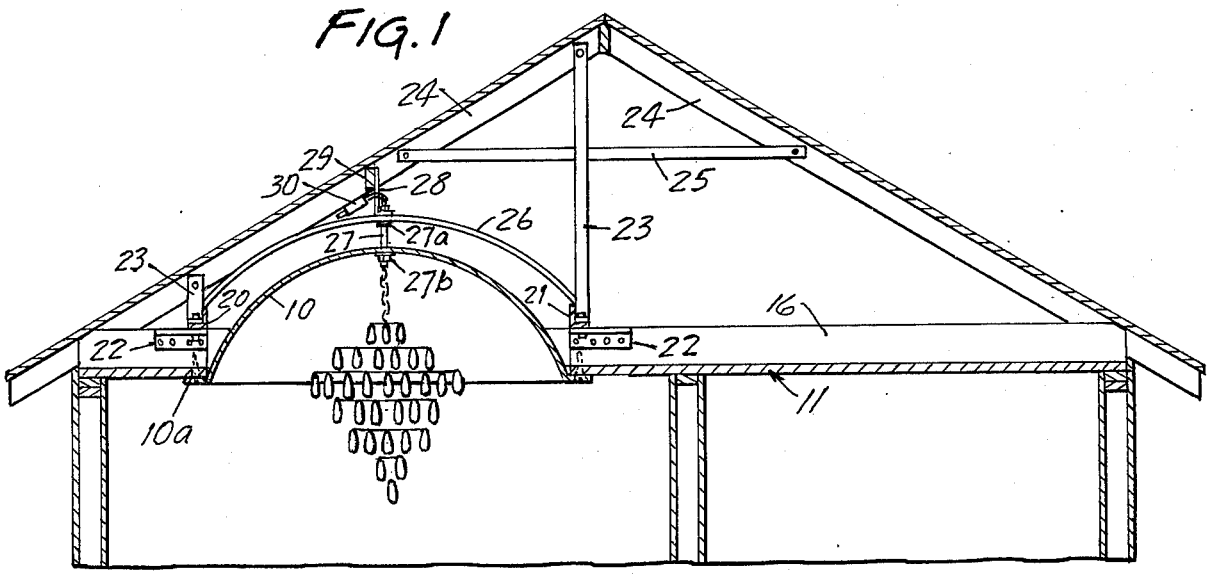
FIG. 1 is a vertical sectional view of a house with my dome and chandelier installed therein taken substantially along the line 1—1 of FIG. 2.

As illustrated in the accompanying drawings I provide a concave dome or concave shell unit 10 in an opening cut in the ceiling oa home such as in the living room ceiling 11 having conventional framing framaing members 12 through 19 as illustrated. Initially an opening, which is the size of the dome to be installed, is circumscribed on the surface of the ceiling. The dome illustrated constitutes a circular shell member 10, however, this shape could obviously be varied. After the desired opening is suitably marked on the ceiling surface the finished ceiling layer is cut out with a suitable cutting tool such as a saber saw. This saw could also cut into the lower portion of the ceiling joist members which are respectively numbered 14 through 17. The remaining joist members which are not cut through are respectively designated by the numerals 12, 13 and 18 and 19.

After the plaster layer and supporting lathe or plaster board has been cut out and removed, each of the joists 14 through 17 which are to be cut must be supported from the remaining frame structure of the building. In the form shown this is accomplished by the use of a pair of elongated beam members 20 and 21 such as the structural angles illustrated. These angles are of sufficient length to extend across and are supported by at least two of the joist members 12, 13 and 18 and 19 which are not to be cut. Each of the joists 12 through 19 is securely attached to the respectiive beam members 20 and 21 as by attachment angles 22 respectively fixed to the bottom leg of said beam angle members as by being bolted or pre-welded thereto. The angles 22 are spaced apart a distance to permit the same to be attached to the joists 12 through 19 as by nails or screws.

Additional vertical support for the joists 12 through 19 may also be provided as by hanger straps or rods 23 fixed at their lower ends to the respective attachment angles 22 and at their upper ends to the roof rafter 24 of the roof frame structure. Suitable tying members such as the strap or tie rod members 25 may also be provided for tying the rafters 24 together above the area where the dome receiving opening has been cut thus preventing spreading of the roof frame structure under the roof loads and the additional load of the dome and chandelier.

After the rafters 14 through 17 have been supported on both sides of the dome-receiving opening as described above, the portion of each of said rafters within the opening is cut out. In other words the rafters are cut through along the line of the opening as defined by the cut out portion of the ceiling layer.

Figure 2:
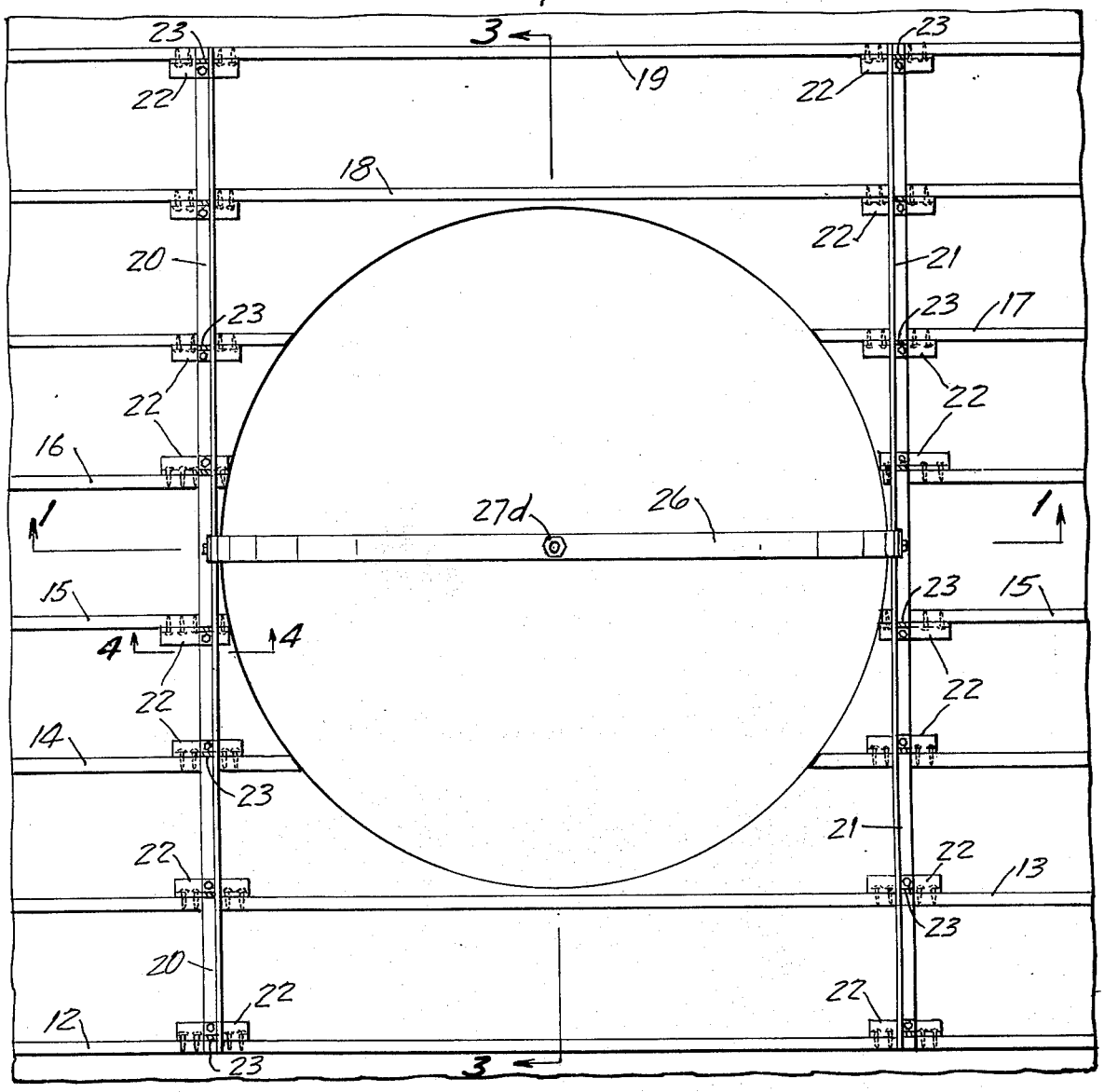
FIG. 2 is a top plan view of such an installation.
Figure 3:
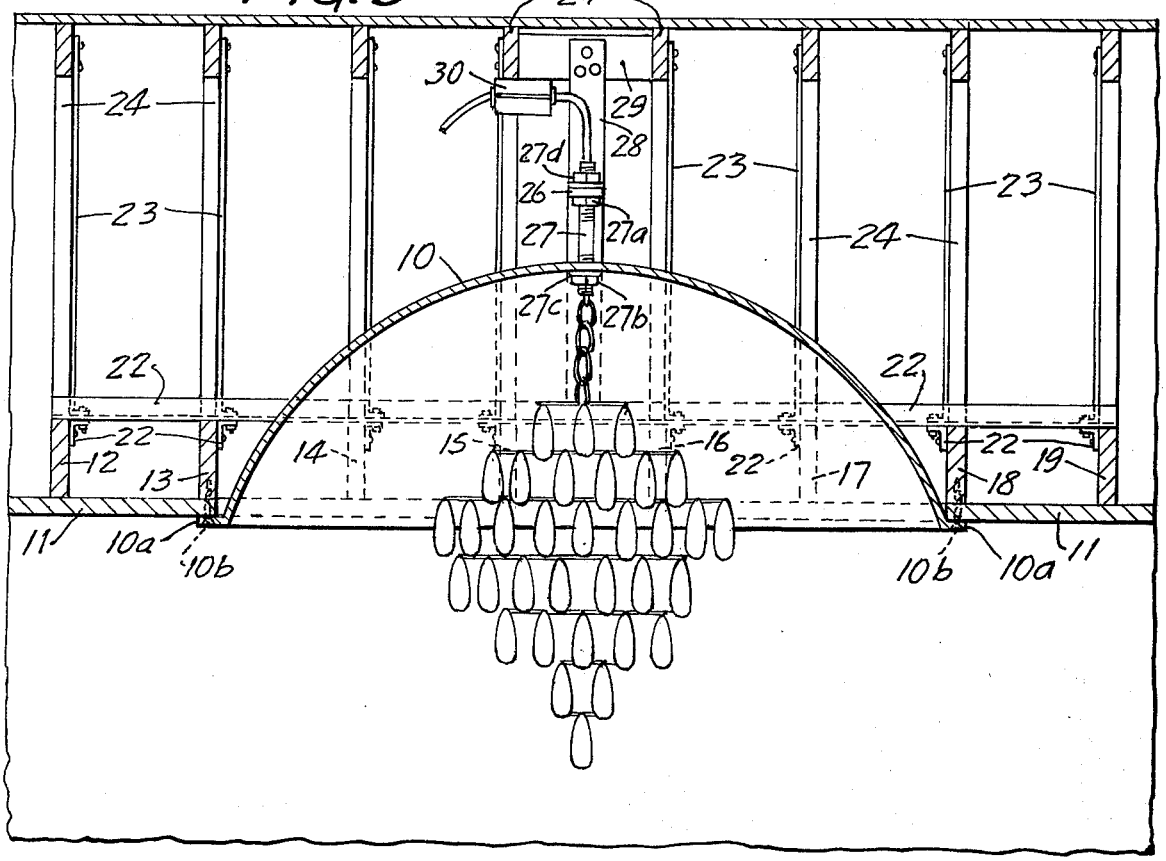
FIG. 3 is a vertical sectional view taken substantially along the line 3—3 of FIG. 2.
Figure 4:
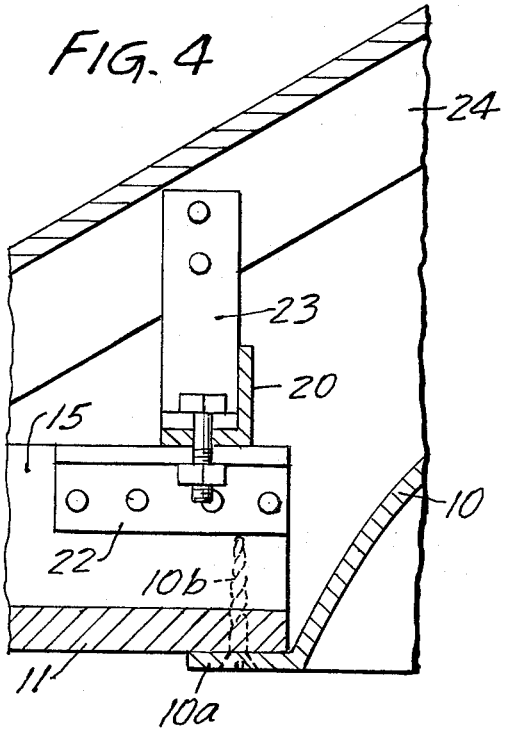
FIG. 4 is an enlarged vertical sectional view taken substantially on the line 4—4 of FIG. 2 showing a typical support for the cut out joist members; and, FIG. 5 is an enlarged fragmentary vertical section of the means for attaching chandelier and dome to the supporting structure.

The center of the dome is supported by an upper arch member 26. If there is sufficient vertical clearance, this arch 26 is mounted at its lower ends on opposite sides of the respective angle beams 20 and 21 as best shown in FIGS. 1 and 2, if not it may be turned 90° and attached directly to the joists 13 and 18. The dome 10 has a lower peripheral attachment flange 10*a*. The flange is attached to the rafters 13 through 18 through the layer of plaster and lathe of the ceiling 11 as by being screwed thereto with screws 10*b*. As illustrated the screws 10*b* are sufficiently long to extend up through the finished plaster ceiling layer 11 into the roof joists 13 through 18. The ends of the cut joists are sufficiently close to the edge of the dome to permit the screws 10*b* to be received therein.

Figure 5:
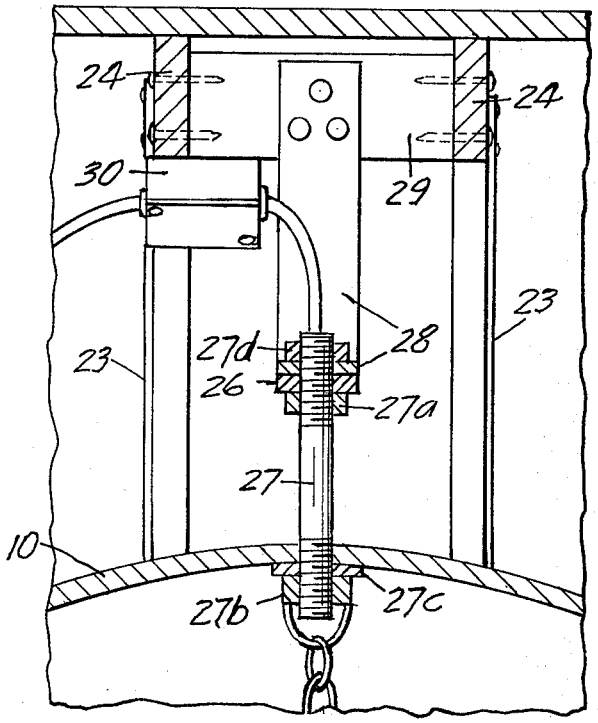

The center of the dome and the chandelier suspended therefrom are supported from an externally threaded conduit member 27 attached to the supporting arch as by a nut 27*a*. A second nut 27*b* is attached at the lower end of the conduit 27 with an enlarged washer 27*c* thereunder to provide additional support for the dome. An additional support such as the strap member 28 may be connected to the upper end of the conduit 27 as by the nut 27*d*, attaches the conduit 27 directly to a bridging member 29 fixed between the overhead rafters 24. The electric wires from the chandelier pass directly up to a junction box 30 fixed to one of the rafters 24 as best shown in FIG. 5.

It will be seen that I have provided a relatively simple ceiling dome structure and supporting means therefor to permit installation thereof in an existing building or during new construction and thus provide a room ceiling with a recess for a chandelier or other suspended light fixture while still providing sufficient head room thereunder. The method of installing the dome and supporting means therefor permits a homeowner to complete the project himself without requiring the assistance of skilled craftsmen.

It will, of course, be understood that various changes may be made in the form, details, arrangement and proportions of the parts without departing from the scope of this invention as set forth in the appended claims.

What is claimed is:

1. The method of mounting a concave chandelier receiving dome in an existing ceiling comprising initially cutting in the finished ceiling layer an opening the size of the dome to be installed to expose the ceiling joists to be cut out above the opening area, supporting each of the joists to be cut from the frame structure of the building, cutting through said joists around the edges of said opening after supporting each of joists to be cut, and installing a concave dome in the opening.

2. The method set forth in claim 1 and installing a pair of main support beams across the ceiling joists to be cut as well as selected joists which are not to be cut, and attaching each of the joists to be cut to said beams to provide said support for the cut out joists.

3. The method set forth in claim 1 and installing a chandelier in the recess of the dome.

4. The method set forth in claim 3 and supporting the chandelier directly from the frame structure of the building.

5. A room ceiling structure in a building and including a finished ceiling a plurality of structural joist members supporting said ceiling and a concave dome mounted in said ceiling in a building for suspending a chandelier type hanging fixture and comprising an integrally formed pre-fabricated concave open bottom dome unit adapted to be installed in a ceiling opening of a size substantially greater than the space between more than two joist members and formed in the ceiling of a building, and having a peripheral flange integrally formed around the lower edge thereof and extending radially outwardly from said lower edge, means supporting the dome unit from the ceiling structure of the building with the flange thereof attached to said ceiling and engaging the surface thereof.

6. The structure set forth in claim 5 and supporting means comprising a pair of beams extending across in overlying relation the cut joist members forming said opening and pre-determined continuous joist members disposed beyond said opening, and means connecting said beams to the underlying joist members to support the cut joist members.

7. The structure set forth in claim 5 and said supporting means comprising a plurality of substantially vertically extending tying elements connected at their lower ends to the cut joist members forming said opening and at their upper ends to the rafters of the roof of the building.

8. The structure set forth in claim 6 and a plurality of spaced substantially vertically extending tying members attached to said supporting beams at their lower ends and to the roof rafters of the building at their upper ends.

9. The structure set forth in claim 7 and a plurality of horizontally disposed tying members attached at their ends to opposed roof rafters overlying said opening to prevent spreading of the lower ends of said rafters.

10. The structure set forth in claim 5 and an arch member extending across the top of said opening above said dome and connected at its lower ends to the supporting structure of the building, and a chandelier supported from said arch member and extending down through the opening in the bottom of the dome and therebelow.

11. The structure set forth in claim 5 and a chandelier mounted in said dome and extending therebelow, and means for supporting the upper end of the chandelier from the roof structure of the building.

12. The structure set forth in claim 5 and a chandelier extending downwardly from the upper portion of the dome unit with at least a portion of the chandelier disposed above the bottom edge of said dome.

* * * * *